US007254978B2

(12) United States Patent
Bergue et al.

(10) Patent No.: US 7,254,978 B2
(45) Date of Patent: Aug. 14, 2007

(54) PROCESS FOR THE HEATING OF FORGING MACHINE TOOLS AND FORGING TOOLS, AND A REMOVABLE FURNACE ELEMENT FOR THE HEATING OF SUCH TOOLS

(75) Inventors: Jean-Pierre Serge Bergue, Soisy Sous Montmorency (FR); Michel Breton, Rieux (FR); Philippe Francois Christian Sagot, Bois Colombes (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 11/256,080

(22) Filed: Oct. 24, 2005

(65) Prior Publication Data

US 2006/0086169 A1 Apr. 27, 2006

(30) Foreign Application Priority Data

Oct. 25, 2004 (FR) ..... 04 52436

(51) Int. Cl.
*B21D 37/16* (2006.01)

(52) U.S. Cl. ..... 72/342.8; 72/342.7; 72/364

(58) Field of Classification Search ..... 72/38, 72/60, 342.1, 342.4, 342.5, 342.7, 342.8, 72/364, 462, 470, 471
See application file for complete search history.

(56) References Cited

U.S. PATENT DOCUMENTS 4,088,000 A 5/1978 Tomioka et al.
4,291,566 A * 9/1981 Dinsdale ..... 72/342.94
4,372,144 A * 2/1983 Valentine et al. ..... 72/352
4,444,039 A 4/1984 Asari et al.
4,730,336 A 3/1988 Herneisen et al.
4,996,863 A * 3/1991 Keeler ..... 72/342.8
5,553,474 A * 9/1996 Nokajima et al. ..... 72/60

FOREIGN PATENT DOCUMENTS

FR 2 683 896 5/1993
JP 60-158940 * 8/1985
JP 1-113145 5/1989

* cited by examiner

*Primary Examiner*—Ed Tolan
(74) *Attorney, Agent, or Firm*—Oblon, Spivak, McClelland, Maier & Neustadt, P.C.

(57) ABSTRACT

This present invention concerns a process for the heating of a forging machine tool, including an insert holder and an insert with one free face bearing a forging impression, in preparation for a forging operation in the said forging machine. The process is characterised by the fact that the insert holder includes a furnace element that has at least one burner and one flue for removal of the gases, forming, with the said face of the insert, a closed heating chamber, the said chamber being heated until the insert reaches a given temperature, when the furnace element is removed.

Figure 1:
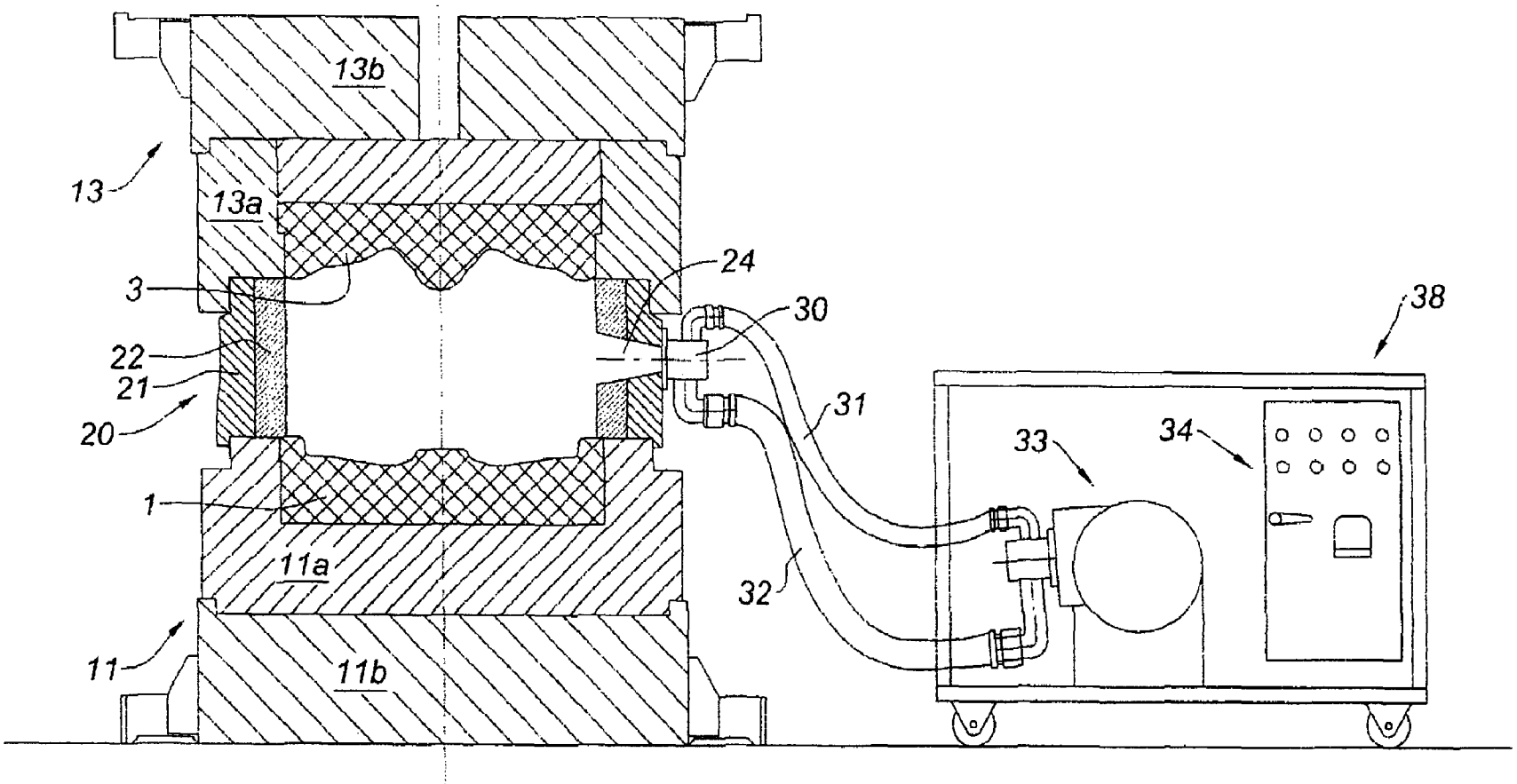

The invention also covers the forging tool, including an insert with an impression, mounted in an insert holder, for implementation of the process, and a removable furnace element.

18 Claims, 2 Drawing Sheets

PROCESS FOR THE HEATING OF FORGING MACHINE TOOLS AND FORGING TOOLS, AND A REMOVABLE FURNACE ELEMENT FOR THE HEATING OF SUCH TOOLS

This present invention concerns the area of forging using pressure-type forging machines such as hydraulic presses.

As the performance of aeronautical turbomachines increases, the parts of which they are made must present improved mechanical characteristics. In particular, this means avoiding the appearance of surface cracks or other faults in the mass. Thus, for aeronautical applications, the use of the titanium alloys has increased in order to satisfy both the requirements of reducing mass and achieving the best compromise between mechanical characteristics and behaviour in service corresponding to performance improvement.

To this end, forging techniques have also evolved. Nowadays, a tool is used that has been heated beforehand in order to ensure better distribution of temperature in the part during the pressing operation.

It is also possible to use an isothermal forging technique, where the part and the tool are brought to the same temperature, but this is difficult and expensive to bring about.

Again, it is possible to use conventional forging machines with a tool of the "hot die" or "hot matrix" type.

The invention is connected in particular with this last technique.

However, the temperature of the steel tool cannot exceed 450 to 500° C., due to the thermo-mechanical limitations of the material.

In order to be able to increase the forging temperature without the need to use an isothermal forging technique, it was necessary to employ higher-strength alloys, such as nickel-based superalloys. This made it possible to heat the tool up to 750° C.

The simplest design would be one using a monoblock tool. However, the cost of this would be high, and the feasibility rendered difficult by the volume of alloy material to be manipulated.

This led to the design of bimetallic tools. The active part, meaning the engraved die, is in nickel-based refractory superalloy. It is mounted in a removable fashion and clamped in a steel support called the insert holder. The function of the latter is to distribute the forces exerted by the press and to store the heat.

For the implementation of this technique, the two elements constituting this tool are heated separately in furnaces that are heated to 450-500° C. and 750° C. respectively. The die is placed in the insert holder, and its position adjusted by means of appropriate retention cleats or keys, and the assembly is then transferred to the machine, where it is secured to mounting plates. These operations are performed for both tools—top and bottom.

The method described above has several drawbacks:

- It is necessary to immobilise two furnaces outside of the forging machine.
- The transfers and the assembly of hot parts give rise to situations of danger for the operators.
- The assembly of the hot parts requires significant play between the two elements, which is incompatible with efficient operation.
- There is a lack of flexibility when production incidents occur, requiring shutdown, since it is then necessary to remove the tools for re-heating.

In order to reduce the amount of handling, it is also possible to effect the heating of the tools by means of a part known as the "martyr". However heating efficiency is very mediocre. There is no control over the temperature. It is always necessary to immobilise two furnaces, one of them at high temperature for the martyr part, of the order of 1000° C.

Another method would be to heat the tools in situ by means of gas jets, but tests have shown that heating efficiency is mediocre as before, with the addition of low yield.

The applicant has set the objective of developing a process for heating the tools of forging machines or presses that will remedy the drawbacks outlined above.

According to the invention, the process for the heating of a forging machine tool, including an insert holder and an insert having one free face bearing a forging impression, in preparation for a forging operation in the said forging machine, is characterised by the fact that the insert holder includes a furnace element that includes at least one burner and one flue for removal of the gases, forming, together with the said face of the insert, a closed heating chamber where the said chamber is heated until the insert reaches a given temperature, upon which the furnace element is removed. Advantageously, the said chamber is heated by the combustion of a combustible fluid within the latter.

In particular, the role of the removable furnace element is to superheat the insert in relation to the insert holder. Preferably, the insert and insert holder assembly are first heated in an oven up to a first temperature which is less than the said given temperature.

The solution of the invention has the following advantages:

- the hot assembly operations of the insert into the insert holder is eliminated, and the hot handling operations, with their associated risks, are reduced.
- The shutdown time of the pressure machine is reduced.
- By the formation of a heating chamber in the immediate vicinity of the insert, it is possible to ensure even heating of the part, with the ability to regulate the heating power and the rise in temperature with precision.
- In the event of a production incident and shutdown of the forging operation, it is not necessary to remove the tool for reheating. It is also possible start up again without difficulty.

In particular, the process is adaptable to each type and geometry of tool.

Thus according to another characteristic, when the forging machine includes two tools each with an insert holder and an insert, use is made of a furnace element in the form of a cylindrical ring. This element is positioned against and between both insert holders so as to constitute the said heating chamber.

When the tool is of the deep cavity type, like an extrusion vessel, use is made of a furnace element in the form of a bell with a bottom wall. This element is placed on the tool so as to constitute the said heating chamber.

According to a particularly advantageous application of the process, advantage is taken of the fact that the materials constituting the insert and the insert holder have different expansion coefficients. The insert, in particular, is a superalloy of nickel and the insert holder is made of steel. The insert is mounted in the insert holder so that it has a negative play, meaning that it is held tightly when the insert is brought to the said given temperature, while still being removable when it returns to a temperature that is below the first temperature, in particular to ambient temperature.

The advantages of this particular solution, are as follows:

In relation to the tools using keys to lock the die in the insert holder, robustness is improved dispersion in the geometrical dimensions is reduced by removing the play, the quality and the geometry of the forged parts is improved since the insert is held firmly in the insert holder and the forces are taken up by the latter.

It also allows the geometry of the insert to be maintained when there is the presence of any surface cracks. The safety and the life expectancy of the insert in are increased. Finally, it allows the manufacturing costs to be reduced by reducing the quantity of superalloy required.

The invention also covers a removable furnace element for implementation of the process. According to one characteristic, it includes a metal wall, coated on the inside with a layer of insulation, and with at least one burner. Preferably, the burner is oriented tangentially so as to produce a vortex-like flow along the wall. The element advantageously includes a means of removing the combustion gases.

The furnace element advantageously forms part of a removable heating assembly comprising a means of feeding with combustion fluids and a resource for regulation of the heating power and time.

Figure 3:
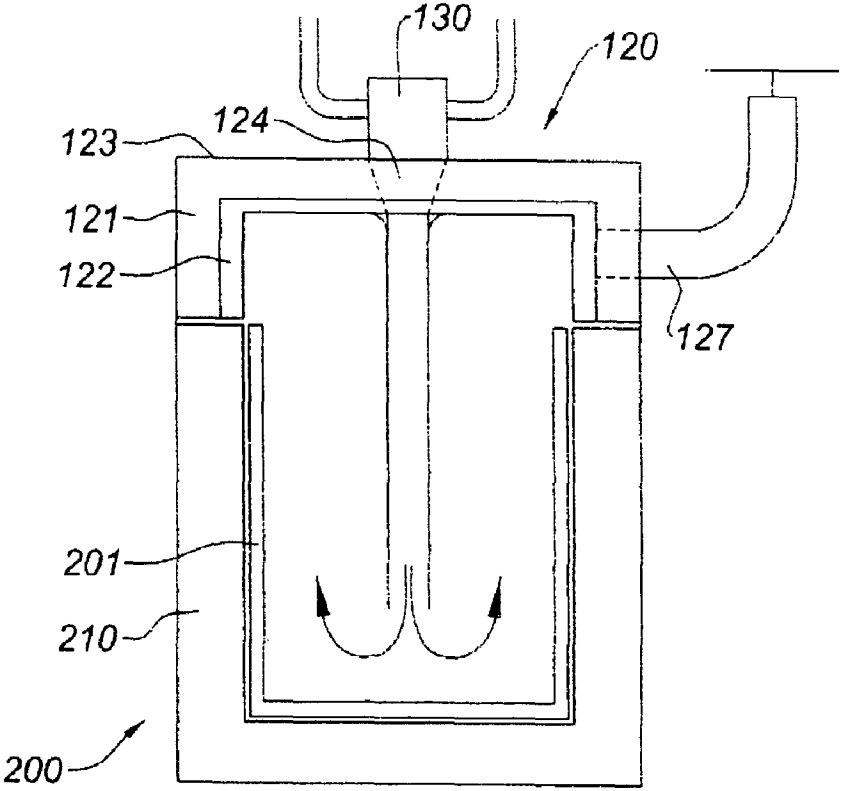
Figure 2:
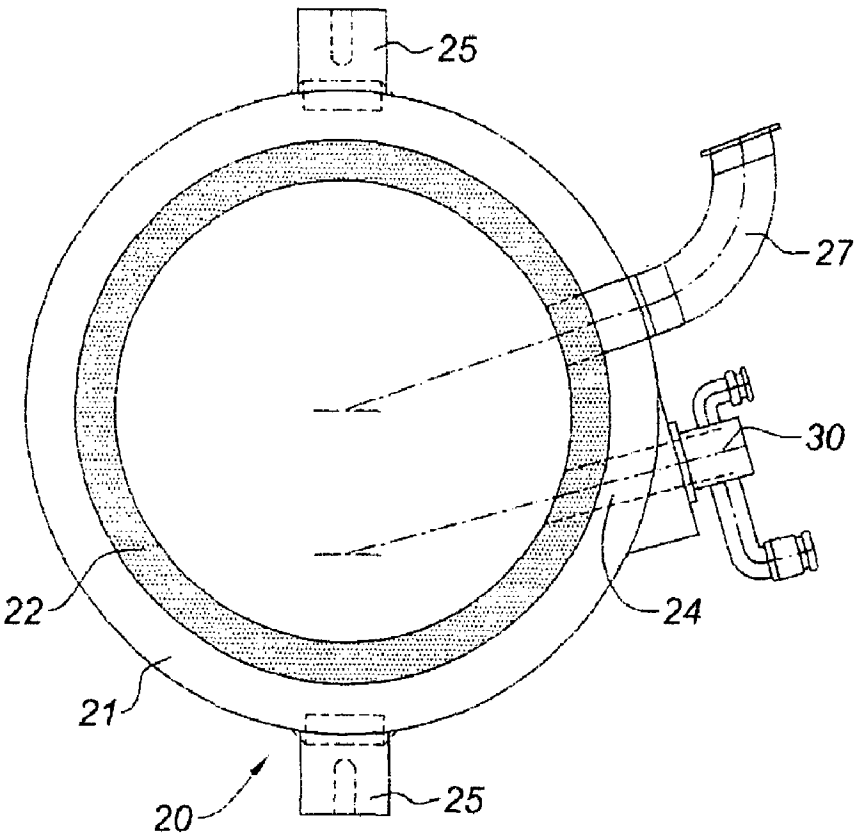

Other characteristics and advantages will appear on reading the following description of one method of implementation of the invention, with reference to the attached drawings, in which:

FIG. 1 is a view in section, in the vertical plane, of a heating installation according to a first application of the invention, FIG. 2 shows the furnace element of FIG. 1, as seen from above, FIG. 3 shows an installation for a second application of the invention.

A forged part is manufactured by placing a blank between two dies or matrices, each bearing an appropriate impression, and then these two dies are moved toward each other with sufficient pressure to deform the blank so as to obtain a part whose geometry matches that of the impressions.

FIG. 1 shows two dies 1 and 3, each with an impression for the manufacture of a part, here a rotor disk for an aeronautical turbomachine, in titanium alloy for example. Both dies or inserts are mounted in two insert holders 11 and 13 respectively. The two insert holders can be made up by the assembly of several parts, here 11*a* and 11*b* for one, and 13*a* and 13*b* for the other, or can each be a single part. The assembly composed of insert 1 and insert holder 11 constitutes the bottom tool 111. The assembly composed of insert 3 and insert holder 13 constitutes the top tool 313. For the forging operations, both tools are mounted in the machine or forging press, which is not shown. In itself, this technique is well known. In fact for the purposes of the invention, any pressure-type forging machine is suitable.

The installation of FIG. 1 includes a removable furnace element 20 placed between the two tools so as to constitute a closed chamber. This chamber is delimited laterally by the wall of the element 20 and transversely by both inserts 1 and 3. It can be seen that the element 20 is pressing vertically on the vertical walls of both insert holders 11 and 13 respectively, so that the latter are outside the chamber.

The wall of the furnace element includes an opening through which a burner 30 opens into the chamber. The burner is supplied with combustion fluids by flexible hoses 31 and 32 connected to a feed unit 38, which here is mobile. This unit includes fluid control resources 33, and resources 34 to monitor this feeding process in order to regulate the heating power, possibly with a means of regulating the temperature. As an example, the fluid feed valve for the combustion can be controlled by a temperature regulator. This involves heating the chamber, preferably as rapidly as possible so as to reduce the heat losses through the wall of the insert holder.

FIG. 2 shows the element 20, isolated and seen from above. This element includes a metal wall 21 carpeted on the inside with an insulating material 22. A non-radial opening 24 is created in the wall and in the insulation. The burner 30 is mounted on the wall 21 and opens into this opening.

A second opening passes through the wall 21 and is connected to a flue 27 for removal of the combustion gases. Finally, it can be seen that lugs 25 are welded to the wall 21 and form grasping points for handling the furnace element.

Heating of the tools is effected in the following manner:

the top and bottom tools are removed from the press.

the tools—the insert and insert holder assembly—are heated in an oven to the said first temperature. When the insert holder is made of steel, this temperature is between 450 and 500° C. This is the temperature that can be tolerated by the insert holder without damage.

both tools are then returned to the press, attached to their respective mounting plates.

the removable furnace element 20 is placed on the bottom insert holder. The geometry of the element 20 is compatible with that of the tool.

The top plate is lowered until the top tool reaches the position of FIG. 1. The top edge of the wall of the furnace element is in contact with the vertical part of the insert holder 13. A closed chamber is thus created. This chamber is delimited firstly by the wall of the furnace element, and secondly by the two inserts.

The burner is then supplied with combustion fluids, gas and air. The flame produced is vortex-like, and this results in the even distribution of temperature. The temperature is caused to rise rapidly in order to reduce the losses of heat by the insert holders.

When the temperature of 750° C. is reached for the superalloy, the heating is stopped and the furnace element is removed.

The press is then ready to execute forging of the parts.

According to one particularly advantageous method of implementation, the inserts 1 and 3 are dimensioned in relation to the positioning in their respective insert holders so that there is a small amount of play at ambient temperature. This play allows the inserts to be inserted and removes easily.

This play is preferably chosen so that it is taken up when the tools leave the oven at the first temperature, between 450 and 500° C.

Then, when the inserts are superheated using the above method, they continue to expand, and are then held tightly in the insert holder. The play is said to be negative. These form an assembly that is very resistant to the stresses to which they are subjected during the forging of parts.

The invention is not limited to the application just described.

FIG. 3 shows, in schematic manner, one application of the process of the invention for the superheating of an insert with a deeply engraved impression. This could be an extrusion vessel.

The tool 200 is composed of an insert holder 210, in steel for example, in the form of a cylindrical pot with a bottom, containing an insert 201 in superalloy. The insert 201 covers the inner wall of the pot. The shape is chosen so as to allow the introduction of a blowing punch vertically into the pot for the extrusion of a metal located in the bottom of the pot.

During the heating operation the pot contains neither a punch nor a part.

In order to effect the superheating of the insert 201, a removable furnace element 120 in the form of a bell, is positioned so that it rests on the lip of the insert holder 210. The element 120 is composed of a cylindrical metal wall 121 that is coated with insulation 122, and of a transverse end wall 123. The diameter is determined by that of the insert holder. On this wall 123, a burner 130 can be seen with its combustion-fluid feed hoses. The burner 130 is extended to the bottom of the pot by a tube 131, in such a way that combustion occurs as close as possible to the bottom of the insert. Arrows indicate the circulation of the hot combustion gases along the inner face of the insert. These gases then exit via the flue 127 attached to the wall 121.

When it is desired to superheat the superalloy insert in relation to the insert holder 210, the furnace element 120 is employed by placing it on the pot 200 so as to constitute a closed chamber, formed firstly by the insert 201 and secondly by the interior of the bell 120. Combustion is created in the chamber so as to heat the insert and raise it to the desired temperature. When the temperature is attained, the bell 120 is removed, and the forging operation can take place.

The invention claimed is:

1. A process for heating a forging machine tool, said method comprising:

providing an insert holder and an insert mounted in said insert holder, said insert holder and said insert being made of different materials, said insert having one free face bearing a forging impression, providing a furnace element and positioning said furnace element on the insert holder, said furnace element having at least one burner and one flue for removal of gases, forming a heating chamber with said free face of the insert and said furnace element, heating said heating chamber until the insert reaches a given temperature, and removing the furnace element.

2. A process according to claim 1, wherein said heating of said heating chamber is performed by combusting a combustible fluid within the heating chamber.

3. A process according to claim 1, further comprising heating the insert holder and the insert beforehand in an oven, up to a first temperature that is less than said given temperature.

4. A process according to one of claims 1 to 3, further comprising:

providing two tools each with an insert holder and an insert, for each tool said insert holder and said insert being made of different materials, said furnace element forming a cylindrical ring between said two tools, and placing the furnace element against and between both insert holders so as to constitute said heating chamber.

5. A process according to one of claims 1 to 3, wherein said forging machine tool is an extrusion vessel, said furnace element forms a bell with a bottom wall, and the method further comprises positioning the furnace element on the extrusion vessel so as to constitute said heating chamber.

6. A process according to claim 1, wherein the insert and the insert holder are made of materials having different expansion coefficients, and are positioned in relation to each other so as to create negative play when the insert is at said given temperature while still being removable when the insert is at a temperature below the first temperature.

7. A process according to claim 1, wherein said step of heating said heating chamber is performed at least until the insert reaches 750° C.

8. A process according to claim 1, wherein said insert holder is made of steel.

9. A process according to claim 8, wherein said insert is made of a superalloy.

10. A process according to claim 9, wherein said superalloy is nickel-based.

11. A process according to claim 9, wherein said step of heating said heating chamber is performed at least until the insert reaches 750° C.

12. A process according to claim 1, further comprising positioning said furnace element relative to said insert holder so that said heating chamber is delimited by said furnace element and by said insert and so that said insert holder is outside said heating chamber.

13. A process according to claim 12, wherein said heating is performed so as to superheat the insert relative to the insert holder.

14. A removable furnace element for implementation of the process according to claim 1, said furnace element comprising a metal wall that is coated on the inside with a layer of insulation, having at least one burner and a means of removing the combustion gases.

15. A removable furnace element according to claim 14, wherein the burner is oriented tangentially so as to produce a vortex-like flow along the wall.

16. A removable furnace element according to one of claims 14 and 15, said furnace element being of annular shape.

17. A removable furnace element according to one of claims 14 and 15, wherein said furnace element forms a bell.

18. A removable heating assembly comprising:

a removable furnace element according to claim 14, means for feeding said heating chamber with combustion fluids, and means for regulating heating power and time in said heating chamber.

* * * * *